US009263020B2

(12) United States Patent
Takasaki

(10) Patent No.: US 9,263,020 B2
(45) Date of Patent: Feb. 16, 2016

(54) CONTROL INFORMATION GENERATING APPARATUS AND METHOD FOR PERCUSSION INSTRUMENT

(71) Applicant: ROLAND CORPORATION, Shizuoka (JP)

(72) Inventor: Ryo Takasaki, Shizuoka (JP)

(73) Assignee: ROLAND CORPORATION, Shizuoka (JP)

( * ) Notice: Subject to any disclaimer, the term of this patent is extended or adjusted under 35 U.S.C. 154(b) by 0 days.

(21) Appl. No.: 14/495,897

(22) Filed: Sep. 25, 2014

(65) Prior Publication Data

US 2015/0090101 A1 Apr. 2, 2015

(30) Foreign Application Priority Data

Sep. 27, 2013 (JP) ..... 2013-201404

(51) Int. Cl.
*G10H 3/14* (2006.01)

(52) U.S. Cl.
CPC ..... *G10H 3/146* (2013.01); *G10H 2220/525* (2013.01); *G10H 2230/275* (2013.01)

(58) Field of Classification Search
CPC ..... G10H 3/146; G10H 2230/275; G10H 2220/525
USPC ..... 84/626
See application file for complete search history.

(56) References Cited

U.S. PATENT DOCUMENTS

| | | | | |
|---|---|---|---|---|
| 6,601,436 | B1 * | 8/2003 | Senda et al. | 73/12.09 |
| 7,405,353 | B2 * | 7/2008 | Kiyono et al. | 84/600 |
| 7,473,840 | B2 * | 1/2009 | Arimoto | 84/615 |
| 2005/0150366 | A1 * | 7/2005 | Susami | 84/735 |
| 2005/0262991 | A1 | 12/2005 | Arimoto | |

FOREIGN PATENT DOCUMENTS

| | | |
|---|---|---|
| JP | 2001-255871 | 9/2001 |

* cited by examiner

*Primary Examiner* — Jeffrey Donels
(74) *Attorney, Agent, or Firm* — Jianq Chyun IP Office

(57) ABSTRACT

Provided is a sound source control information generating apparatus, adapted for performing slapping techniques. According to the present invention, information based on an output value of a first sensor that detects striking on the housing is stored in a memory means. If striking on the struck head of a percussion instrument is detected based on an output value of a second sensor that detects striking on the struck head, whether an output value equal to or greater than a predetermined value is obtained from the first sensor in a predetermined time interval before a timing of detecting the striking on the struck head is determined based on the information stored in the memory means.

15 Claims, 6 Drawing Sheets

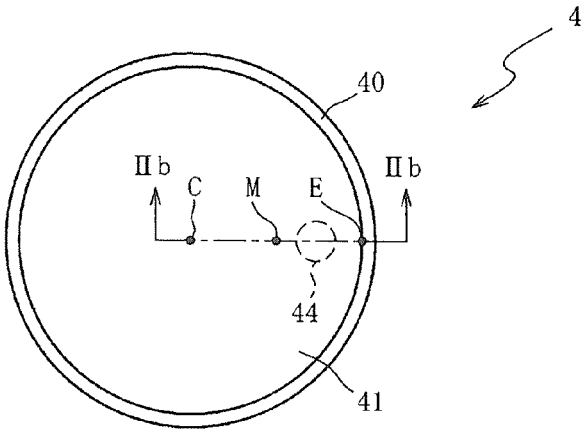
FIG. 2A
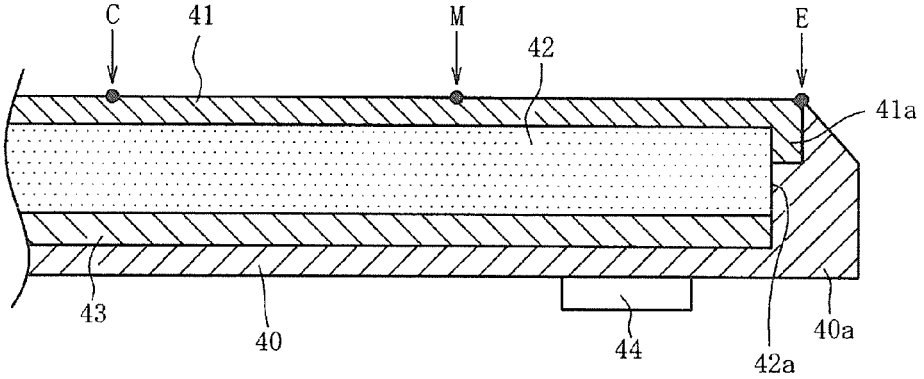
FIG. 2B
reference point sensor output table
| output value of pressure sensor | output value of piezoelectric sensor |
|---|---|
| 1 | P 1 |
| 2 | P 2 |
| 3 | P 3 |
| ⋮ | ⋮ |
| 1 2 7 | P 1 2 7 |
FIG. 2C

CONTROL INFORMATION GENERATING APPARATUS AND METHOD FOR PERCUSSION INSTRUMENT

CROSS-REFERENCE TO RELATED APPLICATION

This application claims the priority benefit of Japan application serial no. 2013-201404, filed on Sep. 27, 2013. The entirety of the above-mentioned patent application is hereby incorporated by reference herein and made a part of this specification.

BACKGROUND OF THE INVENTION

1. Field of the Invention

The present invention relates to a control information generating apparatus and a method thereof and particularly relates to a control information generating apparatus, a method for a percussion instrument adapted for performing a playing technique on the percussion instrument having a housing and a struck head, such as a slapping technique, which utilizes a movement accompanying vibration of the housing to strike the struck head.

2. Description of Related Art

Japanese Patent Publication No. 2001-255871 discloses an electronic percussion instrument that uses a pressure sensor, disposed in a planar shape over the entire surface of the back side of the struck head, and a piezoelectric sensor, disposed on the back side of a case (housing), to detect the striking and the struck point when the struck head is struck.

PRIOR ART LITERATURE

Patent Literature

[Patent Literature 1] Japanese Patent Publication No. 2001-255871

SUMMARY OF THE INVENTION

In terms of the performance using percussion instruments, there is a playing technique called slapping. The slapping technique is to hit a main body end outside the struck head with the player's palm and use the inertia at that moment to strike the struck head with fingers, like snapping. However, the electronic percussion instrument disclosed in Japanese Patent Publication No. 2001-255871 cannot be used for performing slapping for the reason that the striking of the slapping technique on the struck head cannot be distinguished from normal striking on the struck head.

In view of the above, the present invention is directed to providing a sound source control information generating apparatus, a method thereof, and a program adapted for performing a playing technique on an electronic device having a housing and a struck head, such as the slapping technique, which utilizes a movement accompanying vibration of the housing to strike the struck head.

In order to achieve the above, according to the sound source control information generating apparatus, information based on an output value of a first sensor that detects striking on the housing is stored in a memory means. Meanwhile, if striking on the struck head of the electronic device is detected based on an output value of a second sensor that detects the striking on the struck head, whether the housing is struck in a predetermined time interval before a timing of detecting the striking on the struck head is determined based on the information stored in the memory means. If it is determined that the housing is struck, musical sound control information that differs from a situation where it is determined that the housing is not struck is generated. Accordingly, the sound source means can output different musical sounds respectively for the cases where the struck head is struck and not struck in the predetermined time interval after the striking on the housing. Thus, a playing technique, such as the slapping technique, which utilizes the movement accompanying vibration of the housing to strike the struck head, can be performed on the electronic device having the housing and the struck head.

The "first sensor that detects striking on the housing" in the claims is not intended to limit the use of the first sensor to the detection of the striking on the housing. In other words, the first sensor may be used for other purposes in addition to detecting the striking on the housing. Likewise, the second sensor of the "second sensor that detects striking on the struck head" may be used for other purposes in addition to detecting the striking on the struck head.

In addition to the foregoing effects, the sound source control information generating apparatus further achieves the following effects. When the striking on the struck head is detected, if an output value, equal to or greater than a predetermined value, is obtained from the first sensor in the predetermined time interval before a timing of detecting the striking, it is determined that the housing is struck. Thus, whether the housing is struck can be determined based on the output value of the first sensor.

In addition to the foregoing effects, the sound source control information generating apparatus further achieves the following effects. Because the output value of the first sensor is stored sequentially in the memory means to identify the timing of obtaining the output value, whether the housing is struck in the predetermined time interval before the timing of detecting the striking on the struck head can be determined based on the past output value of the first sensor stored in the memory means.

In addition to the foregoing effects, the sound source control information generating apparatus further achieves the following effects. If the output value of the first sensor causes determination that the housing is struck, information based on the output value is stored in the memory means to identify the timing of obtaining the output value. Therefore, whether the housing is struck in the predetermined time interval before the timing of detecting the striking on the struck head can be determined based on the information that is based on the past output value stored in the memory means.

In addition to the foregoing effects, the sound source control information generating apparatus further achieves the following effects. When the striking on the struck head is detected, if an output value, equal to or greater than the predetermined value, is obtained from the first sensor in the predetermined time interval before the timing of detecting the striking and an output value, equal to or greater than the predetermined value, is obtained from the second sensor in the predetermined time interval, a determining means determines that the housing is struck. Thus, the striking of the slapping technique on the struck head that follows the striking on the housing can be distinguished from normal striking on the struck head.

In addition to the foregoing effects, the sound source control information generating apparatus further achieves the following effects. If it is determined that the housing is not struck, musical sound control information based on the output value of the second sensor is generated. On the other hand, if it is determined that the housing is struck, musical sound control information based on the output value of the second sensor and the output value stored in the memory means is generated. Therefore, when the playing technique, which utilizes the movement accompanying vibration of the housing to strike the struck head, is performed on the electronic device having the housing and the struck head, the sound source means can generate a musical sound based on the playing technique.

In addition to the foregoing effects, the sound source control information generating apparatus further achieves the following effects. If it is determined that the housing is struck, the musical sound control information, which differs from a situation where it is determined that the housing is not struck, is a tone control parameter or a volume control parameter. Therefore, when the playing technique, which utilizes the movement accompanying vibration of the housing to strike the struck head, is performed on the electronic device having the housing and the struck head, the sound source means can generate a musical sound with tone or volume corresponding to the playing technique.

BRIEF DESCRIPTION OF THE DRAWINGS

FIG. 2A is a schematic front view of a pad.

FIG. 2B is a schematic cross-sectional view of the pad taken along the line IIb-IIb of FIG. 2A.

FIG. 2C is an example of the content of a reference point sensor output table.

DESCRIPTION OF THE EMBODIMENTS

Figure 1:
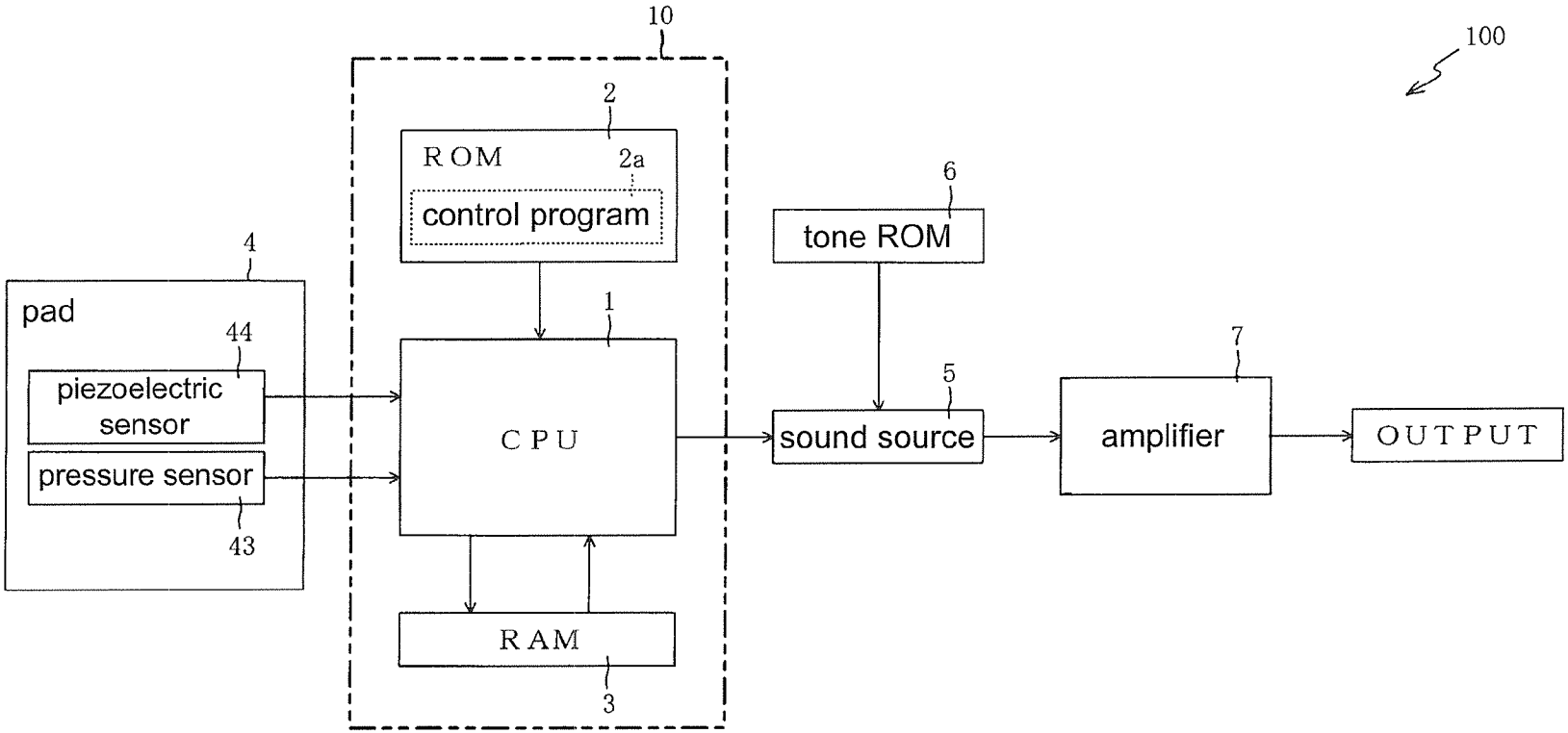
FIG. 1 is a block diagram showing an electrical configuration of an electronic percussion instrument.

Below exemplary embodiments of the present invention are described in detail with reference to the affixed figures. First, the first embodiment of the present invention is described hereinafter with reference to FIG. 1 to FIG. 4. FIG. 1 is a block diagram showing an electrical configuration of an electronic percussion instrument 100 as an embodiment of the present invention. The electronic percussion instrument 100 is an electronic drum, for example. The electronic percussion instrument 100 includes a CPU 1, a ROM 2, a RAM 3, a pad 4, a sound source 5, a tone ROM 6, and an amplifier 7.

The CPU 1 is a central control unit that controls each member of the electronic percussion instrument 100 according to fixed values and programs stored in the ROM 2 and data stored in the RAM 3. The CPU 1 includes a built-in timer (not shown) that measures time by counting a clock signal.

Figure 3:
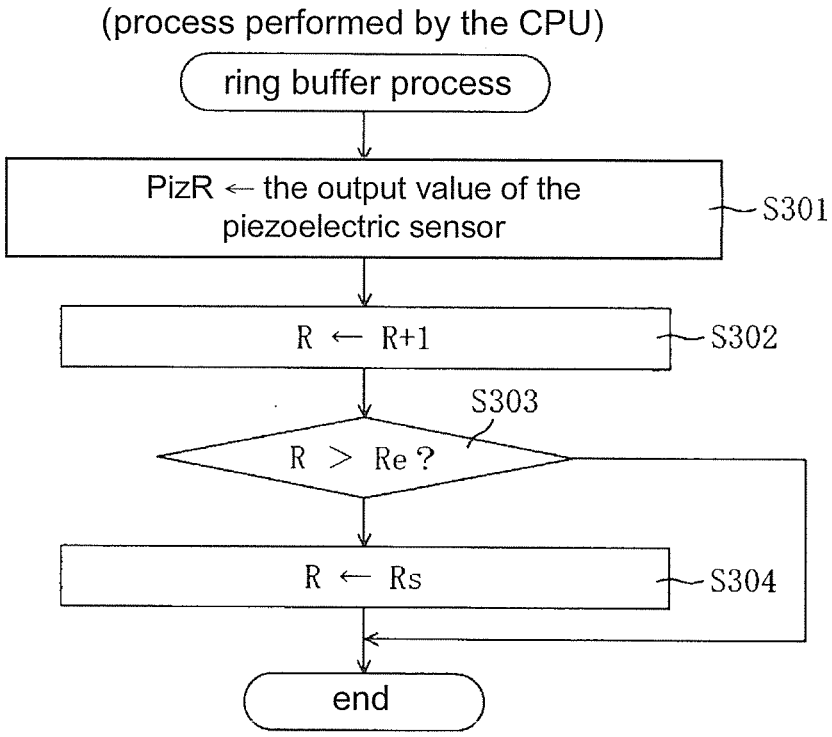
FIG. 3 is a flowchart showing a ring buffer process.
Figure 4:
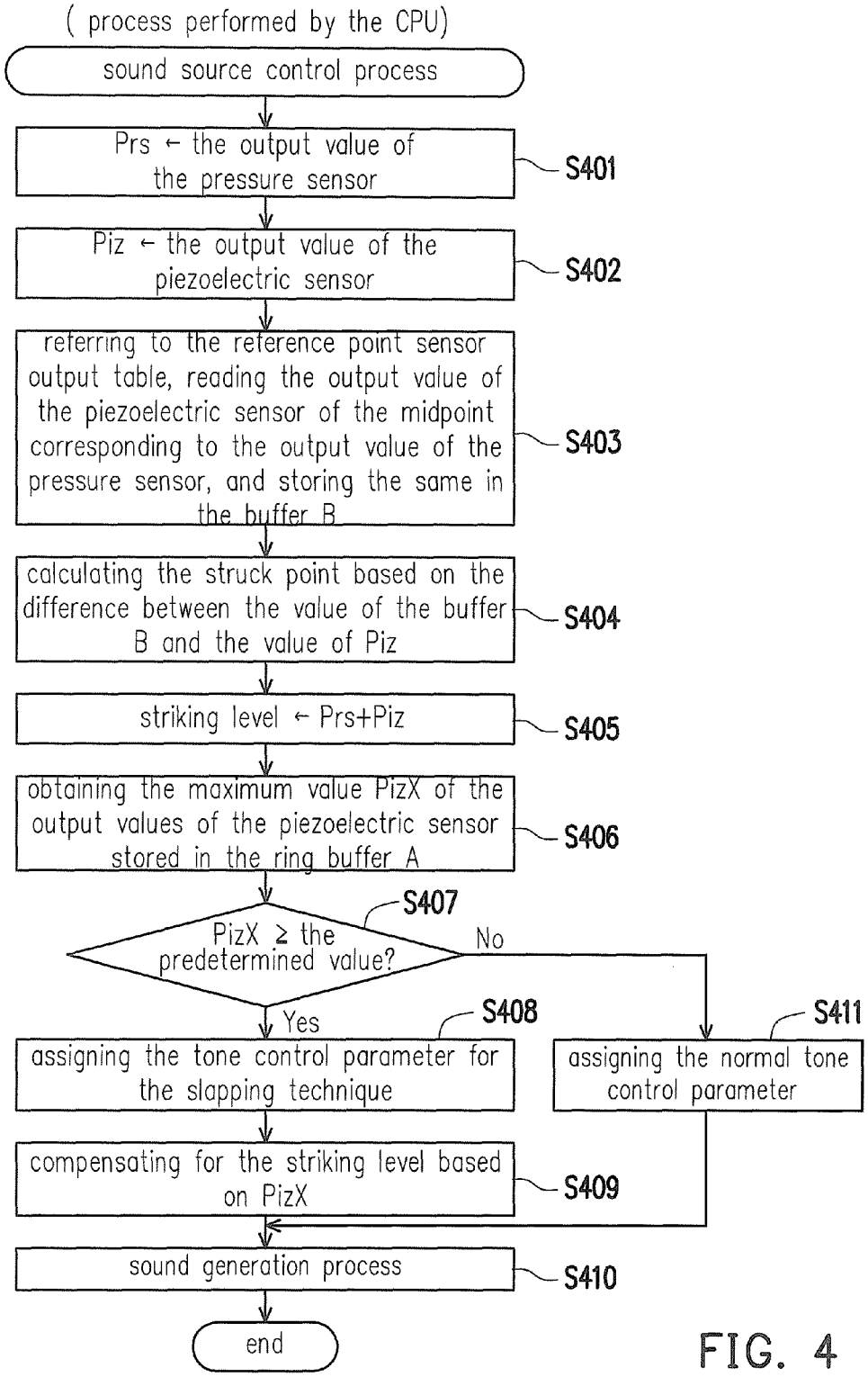
FIG. 4 is a flowchart showing a sound source control process.

The ROM 2 is a read-only memory that stores a control program 2*a* to be executed by the CPU 1. The CPU 1 executes the processes as illustrated by the flowcharts of FIG. 3 and FIG. 4, which will be described later, based on the control program 2*a*. The ROM 2 further stores various tables, such as a reference point sensor output table, which will be described later with reference to FIG. 2C. The RAM 3 is a random access memory that is used by a working area of the CPU 1, for example.

The CPU 1, the ROM 2, and the RAM 3 constitute a sound source control information generating apparatus 10 of the present invention. The sound source control information generating apparatus 10 of this embodiment controls the sound source 5 to generate the musical sound of the slapping technique. Details thereof will be provided below.

The pad 4 is provided for receiving striking on the struck head for electronic drum performance and includes a piezoelectric sensor 44 and a pressure sensor 43. A structure of the pad 4 will be described in detail with reference to FIG. 2A and FIG. 2B later. The sound source 5 is a device that controls the tone or various effects of the musical sound generated in accordance with an instruction from the CPU 1. The tone ROM 6 is a read-only memory that stores tone data. The sound source 5 performs tone control by using the tone data stored in the tone ROM 6. The amplifier 7 is a device that amplifies a musical signal generated by the sound source 5, and outputs the amplified musical signal to a speaker system, etc. (not shown).

FIG. 2A is a schematic front view of the pad 4. FIG. 2B is a schematic cross-sectional view of the pad 4 taken along the line IIb-IIb of FIG. 2A. The pad 4 is a device having a disc shape and includes a case 40 and a struck head 41 disposed on an upper side of the case 40, wherein the case 40 is a circular dish-shaped plate made of a rigid body, and the struck head 41 is composed of a circular rubber pad. On a lower (back) side of the struck head 41, a circular plate-shaped cushion material 42 and the pressure sensor 43 are held in a form of being tightly sandwiched by the struck head 41 and the case 40.

The cushion material 42 provides functions of adjusting the feeling of striking the struck head 41 to a comfortable degree with elasticity and attenuating the vibration of the striking to prevent the striking vibration from directly transmitting to the case 40 in a vertical downward direction of the struck head 41. The cushion material 42 attenuates the striking vibration when the struck head 41 is struck and meanwhile transmits the pressure applied on the struck head 41 by the striking to the pressure sensor 43.

An end portion 41*a* of the struck head 41 is fixed in a manner of being held by an edge portion 40*a* of the case 40 and an end portion 42*a* of the cushion material 42. On the back side of the case 40, the piezoelectric sensor 44 which serves as a vibration sensor, is attached on the side of the edge portion 40*a*. When the struck head 41 is struck, the striking vibration, which is transmitted to the edge portion 40*a* through the struck head 41, is transmitted to the case 40 through the edge portion 40*a* and reaches the piezoelectric sensor 44.

The vibration detected by the piezoelectric sensor 44 when the struck head 41 is struck is mainly the vibration that is transmitted from the struck head 41 through the case 40 along the side of the edge portion 40*a* and reaches the piezoelectric sensor 44. As mentioned above, the vibration transmitted in the vertical downward direction of the struck point is absorbed or attenuated by the cushion material 42, and most of the vibration is not transmitted to the piezoelectric sensor 44. The piezoelectric sensor 44 is disposed at a location such that the length of a path of the striking vibration transmitted from the struck point to the piezoelectric sensor 44 varies depending on different struck points of the struck head 41. In this way, since the piezoelectric sensor 44 detects the striking vibration through the struck head 41 and the case 40, an output value generated by the piezoelectric sensor 44 when an edge E side of the struck head 41 is struck is greater than an output value generated when the struck head 41 is struck near a pad center C.

The piezoelectric sensor 44 also detects the vibration caused by the striking on the case 40, not limited to the struck head 41. If the case 40 is hit with the palm, the piezoelectric sensor 44 detects the vibration of the case 40 based on the hit of the palm. When striking on the struck head 41 is detected, if the piezoelectric sensor 44 detects vibration, equal to or greater than a predetermined level, in a predetermined time interval (12.8 msec in this embodiment) before a timing of detection of the striking, the sound source control information generating apparatus 10 of this embodiment deems that the slapping technique is performed and controls the sound source 5 to generate a musical sound of the tone for the slapping technique.

When the struck head 41 is struck, the pressure sensor 43 detects the pressure received by the struck head 41 due to the striking, and the pressure sensor 43 is disposed in a planar shape over the entire surface of the back side of the struck head 41 and does not detect the pressure when the case 40 is struck. The "planar shape" may refer to an uninterrupted plane shape or a mesh (net) shape, for example, or the "planar shape" may also be a spiral shape as long as the pressure sensor 43 can detect the striking pressure and generate a single detection output when any part of the struck head is struck.

FIG. 2C is an example of the content of the reference point sensor output table stored in the ROM 2. The reference point sensor output table associates the output value of the pressure sensor 43 obtained when a reference point of the struck head 41 of the pad 4 is struck with a stick with the output value of the piezoelectric sensor 44. In this embodiment, a midpoint M near the center of the edge E and the pad center C of the struck head 41 serves as the reference point. The reference point sensor output table is prepared by obtaining in advance the output values of the sensors 43 and 44 respectively corresponding to different striking strengths when the midpoint M, serving as the reference point, is struck by strengths of 127 levels. In the example of FIG. 2C, the output value of the piezoelectric sensor 44 is represented by "P1" when the output value of the pressure sensor 43 corresponding to the striking strength of the first level is "1"; the output value of the piezoelectric sensor 44 is represented by "P2" when the output value of the pressure sensor 43 corresponding to the striking strength of the second level is "2"; and the rest of the output values of the sensors 43 and 44 can be represented in the same manner till the $127^{th}$ level.

Next, the processes performed by the electronic percussion instrument 100 having the aforementioned configuration, or more specifically the CPU 1 of the sound source control information generating apparatus 10, are explained with reference to FIG. 3 and FIG. 4. First, FIG. 3 is a flowchart showing a ring buffer process. This process stores the output value of the piezoelectric sensor 44 in a ring buffer A (not shown) provided in the RAM 3. This process is a timer interrupt process that the CPU 1 performs periodically at a predetermined cycle. In this embodiment, the cycle of performing the ring buffer process is 400 sec. Moreover, in this embodiment, the ring buffer A used in this process is configured to retain 32 pieces of data. Thus, in this embodiment, the output value of the piezoelectric sensor 44 is retained in the ring buffer A over 12.8 msec.

When power is applied, the CPU 1 sets a timer time corresponding to the cycle of performing the ring buffer process as an initial setting. In this embodiment, the cycle of performing the ring buffer process is 400 μsec. In addition, the CPU 1 prepares for storing the output value of the piezoelectric sensor 44 to the ring buffer A and inputs Rs as an address variable R. The address variable R indicates a current data input target address among addresses of the ring buffers A. Rs is an initial address of the ring buffer A.

The CPU 1 initiates the ring buffer process of FIG. 3 every time the timer time set in the initial setting lapses. In the ring buffer process, the CPU 1 stores the output value of the piezoelectric sensor 44 at that time in PizR (S301). Then, the CPU 1 prepares for storing the output value of the piezoelectric sensor 44 in the process to be performed next and adds 1 to the address variable R for proceeding to the next data input target address (S302).

The CPU 1 determines whether the address indicated by the address variable R is an address outside an area of the ring buffer A (S303). More specifically, in S303, the CPU 1 determines whether the address variable R exceeds Re which is an end address of the ring buffer A.

If the CPU 1 determines that the address variable R exceeds Re (S303: Yes), the CPU 1 substitutes Rs for the address variable R (S304) and ends this process to return the data input target address to the beginning of the ring buffer A. On the other hand, if the CPU 1 determines that the address variable R does not exceed Re (S303: No), this process is ended.

FIG. 4 is a flowchart showing a sound source control process. The CPU 1 constantly monitors the output value of the pressure sensor 43 of the pad 4 and detects whether the struck head 41 is struck based on the output value of the pressure sensor 43. The CPU 1 serves as a trigger for the detection of the striking on the struck head 41 and executes this process, which instructs the sound source to generate a sound, by an interrupt process.

The CPU 1 stores the output values of the pressure sensor 43 and piezoelectric sensor 44 at that time in a register Prs and a register Piz respectively (S401, S402). Then, the CPU 1 refers to the reference point sensor output table stored in the ROM 2 to read the output value of the piezoelectric sensor 44 corresponding to the output value of the pressure sensor 43 at the time of the striking in the reference point sensor output table and store the same in a buffer B (not shown) provided in the RAM 3.

The CPU 1 obtains difference data by calculation of "(the value of the buffer B)−(the value of the register Piz)" and uses the difference data as struck point data (S404). The struck point data, i.e. the difference data, indicates to what extent the striking of this time is made on the edge E side or on the pad center C side with respect to the reference point (the midpoint M in this embodiment). To be more specific, if the struck point data is a negative value, it indicates that the striking is made on the edge E side with respect to the midpoint M. On the other hand, if the struck point data is a positive value, it indicates that the striking is made on the pad center C side with respect to the midpoint M.

The CPU 1 calculates a sum of the value of the register Prs (i.e. the output value of the pressure sensor 43) and the value of the register Piz (i.e. the output value of the piezoelectric sensor 44) and stores the obtained value as the striking level in the RAM 3 (S405). The value of the register Prs and the value of the register Piz may be weighted respectively by multiplying a coefficient as appropriate to calculate the sum.

The CPU 1 obtains a maximum value PizX of the output values of the piezoelectric sensor 44 stored in the ring buffer A (S406). In other words, the CPU 1 obtains the maximum value PizX of the output of the piezoelectric sensor 44 in the predetermined time interval (12.8 msec in this embodiment) before the timing of detecting the striking on the struck head 41.

The CPU 1 determines whether the value of PizX is equal to or greater than a predetermined value (S407). If the CPU 1 determines that the value of PizX is not equal to or not greater than the predetermined value, namely, less than the predetermined value (S407: No), the CPU 1 deems that the case 40 is not struck with the palm by the slapping technique, and assigns a normal tone control parameter (S411) and proceeds to S410.

In contrast, if the CPU 1 determines that the value of PizX is equal to or greater than the predetermined value (S407: Yes), the CPU 1 deems that the case 40 is struck with the palm by the slapping technique and assigns a tone control parameter for the slapping technique (S408). More specifically, the tone control parameter that causes the sound source 5 to generate a sound based on the tone data of the slapping technique stored in the tone ROM 6 is assigned.

With tone data, which corresponds to the striking level of the palm on the case 40, prepared in advance in the tone ROM 6 for the slapping technique, in S408, the CPU 1 may also be configured to assign a tone control parameter for generating a sound of the tone data corresponding to the value of PizX. By such a configuration, the unique tone of the slapping technique corresponding to the strength of the striking of the player's palm can be generated when the slapping technique is performed.

Next, the CPU 1 compensates for the striking level calculated in S405 based on the value of PizX (S409). To be more specific, in S409, the CPU 1 first refers to a table (not shown), which is stored in the ROM 2 and associates the value of PizX with a level compensation value, and reads the level compensation value corresponding to the PizX. Thereafter, the CPU 1 multiplies the read level compensation value by the striking level calculated in S405. By the calculation, the striking level calculated in S405 is compensated to a value based on the strength of the striking of the palm when the slapping technique is performed. By compensating the striking level as described above, the musical sound of the unique volume of the slapping technique corresponding to the strength of the striking of the player's palm can be generated when the slapping technique is performed.

After S409 or S411, the CPU 1 performs a sound generation process to instruct the sound source 5 to generate a sound (S410) and ends this process. More specifically, in S410, as the sound generation instruction is outputted to the sound source 5, various control parameters, such as the tone control parameter assigned in S408 or S411 or a volume control parameter corresponding to the striking level, are outputted. If compensation of the striking level is carried out in S409, the volume control parameter outputted in S410 corresponds to the compensated striking level. The result of S410 is that the sound source 5 performs the sound generation process corresponding to various outputted control parameters.

With the above sound source control process, when the slapping technique is performed, the sound source 5 generates the musical sound of the tone in accordance with the tone control parameter assigned in S408 for the slapping technique, that is, the musical sound of the tone of the slapping technique. On the other hand, if the struck head 41 is struck by a normal technique, the sound source 5 generates the musical sound of the tone according to the normal tone control parameter assigned in S411.

Further, regarding the volume of the musical sound, when the slapping technique is performed, the sound source 5 sets the value of the sum of the value of the register Prs (the output value of the pressure sensor 43) and the value of the register Piz (the output value of the piezoelectric sensor 44) as the volume corresponding to the striking level, wherein the striking level is compensated according to the strength of the striking of the player's palm on the case 40. On the other hand, when the struck head 41 is struck by the normal playing technique, the sound source 5 outputs the volume corresponding to the striking level, which is the value of the sum of the value of the register Prs and the value of the register Piz.

According to the sound source control information generating apparatus 10 of the first embodiment, the output value of the piezoelectric sensor 44 in the predetermined time interval is stored in the ring buffer A. Thus, when striking on the struck head 41 is detected, an output state of the piezoelectric sensor 44 in the predetermined time interval before the timing of detecting the striking can be identified. Here, if any output of the piezoelectric sensor 44 is equal to or greater than the predetermined value in the predetermined time interval, it is deemed that the slapping technique is performed, and the tone control parameter for the slapping technique is outputted to the sound source 5. Therefore, the musical sound of the tone of the slapping technique can be outputted from the sound source 5. Accordingly, when using the electronic percussion instrument 100 provided with the sound source control information generating apparatus 10, the user can perform the slapping technique.

Next, the second embodiment of the present invention is explained below with reference to FIG. 5 and FIG. 6. In the first embodiment as described above, the configuration includes storing the output value of the piezoelectric sensor 44 in the predetermined time interval in the ring buffer A and determining whether the case 40 is struck in the predetermined time interval before the timing of detecting striking on the struck head 41 based on the content stored in the ring buffer A. In contrast to the above, in the second embodiment, the output of the piezoelectric sensor 44 is monitored constantly and, if any output of the piezoelectric sensor 44 is equal to or greater than the predetermined value, the output is identifiably stored for determining whether the case 40 is struck in the predetermined time interval before the timing of detecting striking on the struck head 41. In the second embodiment, the same reference numerals are used to denote components the same as the first embodiment. Thus, detailed descriptions thereof are not repeated hereinafter.

Figure 5:
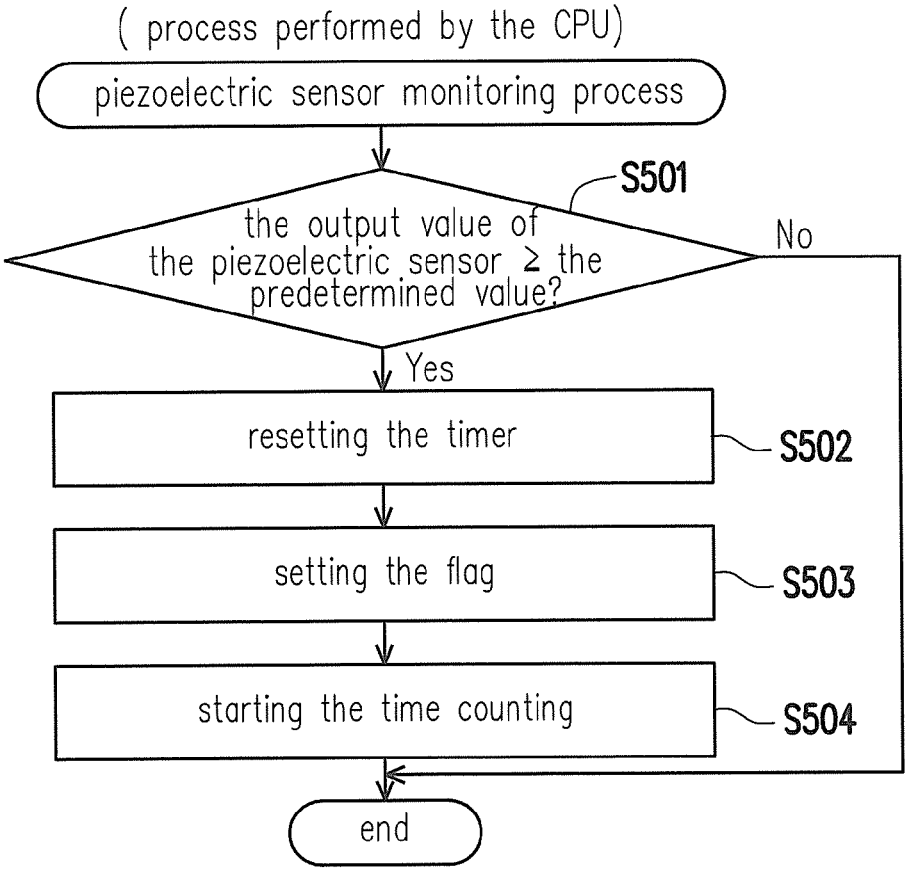
FIG. 5 is a flowchart showing a piezoelectric sensor monitoring process.

FIG. 5 is a flowchart showing a piezoelectric sensor monitoring process. This process monitors the output of the piezoelectric sensor 44. This process is a timer interrupt process that the CPU 1 performs periodically at a predetermined cycle. In this embodiment, the cycle of performing the piezoelectric sensor monitoring process is 400 μsec. The CPU 1 performs this process and the processes of the sound source control process of FIG. 6, which will be described later, based on the control program 2*a* of the second embodiment.

The CPU 1 determines whether the output value of the piezoelectric sensor 44 is equal to or greater than the predetermined value (S501). If the determination of the CPU 1 is affirmative (S501: Yes), the CPU 1 resets a timer (not shown) built therein (S502). Then, the CPU 1 sets a flag (not shown), which is provided in the RAM 3 and indicates whether any output of the piezoelectric sensor 44 is equal to or greater than the predetermined value (S503). In the initial setting that is performed when power is applied, the CPU 1 clears the flag. The CPU 1 starts counting time by the timer (S504) and ends this process. On the other hand, if the CPU 1 determines that the output value of the piezoelectric sensor 44 is less than the predetermined value in S501 (S501: No), the CPU 1 ends this process.

When time counting is started by S504, the CPU 1 performs a time counting process, which is not shown here. In the time counting process, when the predetermined time interval, e.g. 12.8 msec, the same as the first embodiment, lapses after the start of the time counting, the CPU 1 clears the set flag, ends the time counting, and resets the timer in S503.

Figure 6:
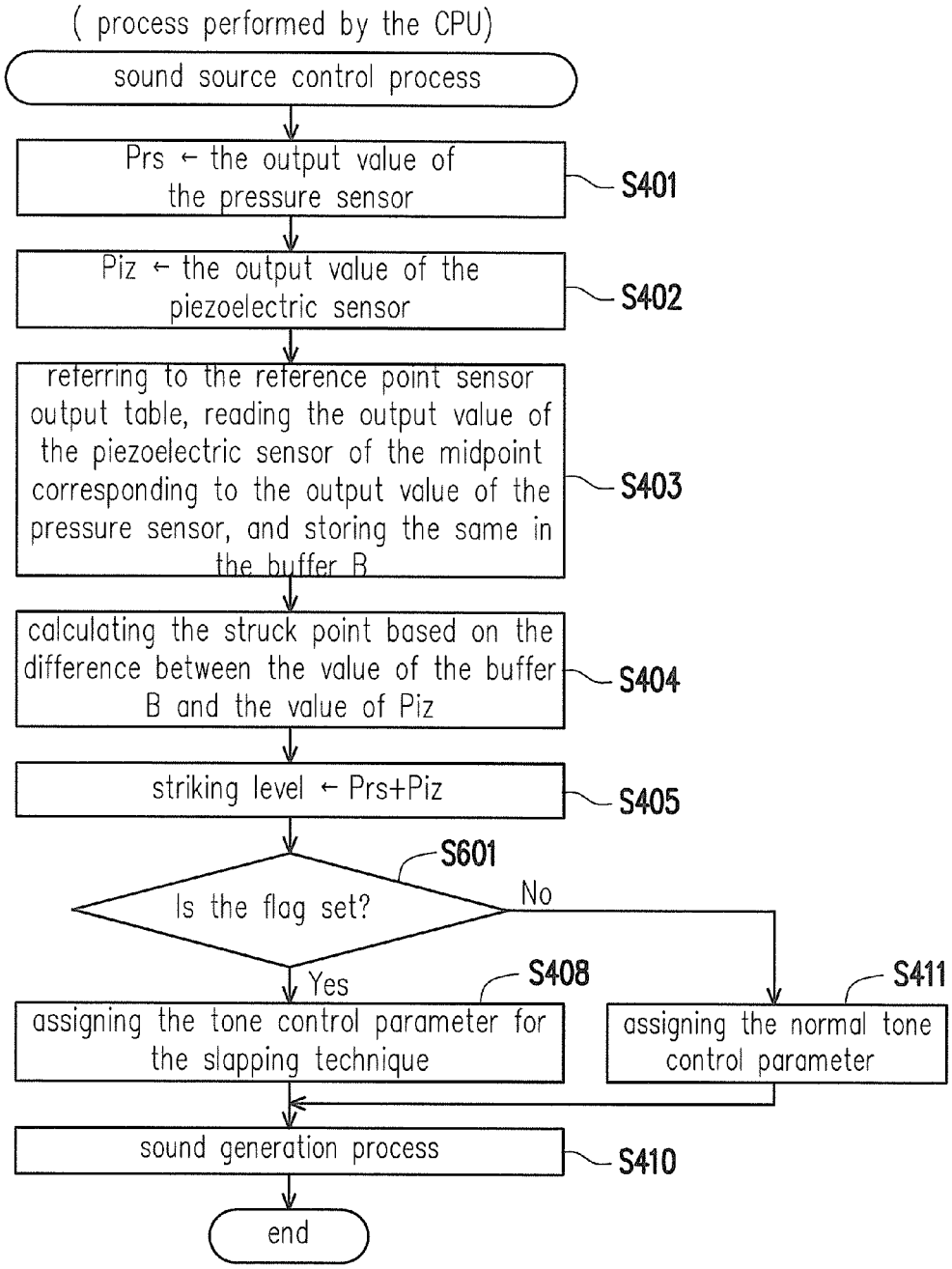
FIG. 6 is a flowchart showing a sound source control process of the second embodiment.

FIG. 6 is a flowchart showing the sound source control process of the second embodiment. In this process, the CPU 1 determines whether the flag (the flag that indicates whether any output of the piezoelectric sensor 44 is equal to or greater than the predetermined value) is set after performing S401-S405, the same as the first embodiment.

If the CPU 1 determines that the flag is not set (S601: No), the CPU 1 performs S411 and S410 and ends this process. In contrast, if the CPU 1 determines that the flag is set (S601: Yes), the CPU 1 performs S408 and S410 and ends this process.

If the flag is set, the output value related to the setting of the flag may be associated with and stored in the flag. In such a configuration, S409 that compensates for the striking level may be performed after S408, the same as the first embodiment. In that case, the striking level is compensated based on the output value associated with the flag.

According to the sound source control information generating apparatus 10 of the second embodiment, if it is determined that the output value of the piezoelectric sensor 44 is equal to or greater than the predetermined value, the flag is set over the predetermined time interval to serve as information for identifying the output value. Thus, when striking on the struck head 41 is detected, whether any output of the piezoelectric sensor 44 is equal to or greater than the predetermined value in the predetermined time interval before the timing of detecting the striking can be determined. Accordingly, the same as the first embodiment described above, the user can perform the slapping technique.

In the above embodiments, the sound source control information generating apparatus 10 is an example of the sound source control information generating apparatus. The control program 2*a* is an example of the program. The electronic percussion instrument 100 is an example of the electronic device. The CPU 1 is an example of a computer. The case 40 is an example of the housing. The struck head 41 is an example of the struck head. The sound source 5 is an example of the sound source means. The piezoelectric sensor 44 that serves as the vibration sensor is an example of the first sensor. The pressure sensor 43 and the piezoelectric sensor 44 that serve as the striking sensors are examples of the second sensor. The ring buffer A or the RAM 3 provided with the flag that indicates whether any output of the piezoelectric sensor 44 is equal to or greater than the predetermined value is an example of the memory means. The ring buffer A is an example of the ring buffer. The flag that indicates whether any output of the piezoelectric sensor 44 is equal to or greater than the predetermined value is an example of the information for identifying the output value.

In the above embodiments, the CPU 1 that executes S401 is an example of a first acquisition means. The CPU 1 that executes S402 is an example of a second acquisition means. The CPU 1 that starts the processes illustrated by the flowcharts of FIG. 4 and FIG. 6 is an example of a striking detection means. The CPU 1 that executes the ring buffer process of FIG. 3 or the piezoelectric sensor monitoring process of FIG. 5 is an example of a memory control means. The CPU 1 that executes S407 and S601 is an example of a determining means. The CPU 1 that executes S408-S410 or S408 and S410 is an example of a control means. The CPU 1 that executes S301 of the first embodiment and S501 of the second embodiment is an example of a first determining means. The CPU 1 that starts the processes illustrated by the flowcharts of FIG. 4 and FIG. 6 is an example of a second determining means. The CPU 1 that executes S407 of the first embodiment and S601 of the second embodiment is an example of a third determining means. The CPU 1 that executes S408-S410 of the first embodiment and S408 and S410 of the second embodiment is an example of a generation means. The CPU 1 that executes S502 and S504 is an example of a time counting means.

The above illustrates the present invention on the basis of the embodiments. However, it should be understood that the present invention is not limited to any of the embodiments, and various modifications or alterations may be made without departing from the spirit of the present invention.

In the above embodiments, the configuration adopts 12.8 msec as the predetermined time interval for determining whether the interval between strokes on the case 40 and strokes on the struck head 41, namely, a time period that the data is stored in the ring buffer A in the first embodiment and a time period that the flag is set in the second embodiment, is caused by the slapping technique. The predetermined time interval can be any appropriate time period as long as the predetermined time interval is shorter than an interval T (generally, about 100 msec) between consecutive strokes on the struck head 41 and equal to or longer than a minimum time t between the striking on the case 40 and the striking on the struck head 41 required for performing the slapping technique. That is, if the predetermined time interval is $\tau$, $\tau$ can be any appropriate value as long as $\tau$ satisfies the relation of $T>\tau\geq t$.

In the first embodiment, by using the $\tau$ value that satisfies the relation of $T>\tau\geq t$, the content stored in the ring buffer A at the timing that the striking on the struck head 41 is detected does not include the output value of the piezoelectric sensor 44 that results from consecutive strokes on the struck head 41. Therefore, in S407 of FIG. 4, whether the case 40 is struck can be determined based on the content stored in the ring buffer A, i.e. the output value of the piezoelectric sensor 44, and in the second embodiment, the content stored in the ring buffer A at the timing that the striking on the struck head 41 is detected does not include the output value of the piezoelectric sensor 44 that results from consecutive strokes on the struck head 41.

In the second embodiment, by using the $\tau$ value that satisfies the relation of $T>\tau\geq t$, information based on the output value of the piezoelectric sensor 44 that results from consecutive strokes on the struck head 41 is not included in the state of the flag at the timing that the striking on the struck head 41 is detected. Thus, in S601 of FIG. 6, whether the case 40 is struck can be determined based on the state of the flag, i.e. the information based on the output value of the piezoelectric sensor 44.

In the above embodiments, the circular plate-shaped cushion material 42 and the pressure sensor 43 are held in a form of being tightly sandwiched by the struck head 41 and the case 40 on the lower (back) side of the struck head 41, as shown in FIG. 2B. Therefore, the pressure sensor 43 has lower responsiveness to the striking on the struck head 41 and does not detect the intense pressure variation caused by consecutive strokes on the struck head 41 at short time intervals. Since the pressure sensor 43 cannot detect intense pressure variation of the struck head 41 even if the struck head 41 is struck consecutively with a time interval equal to or shorter than the interval from the striking on the case 40 to the striking on the struck head 41 made by the palm in the slapping technique, the situation that the sound generation process of the slapping technique is mistakenly performed, instead of the sound source control process shown in the flowchart of FIG. 4 of the first embodiment or the sound source control process shown in the flowchart of FIG. 6 of the second embodiment, does not occur.

However, even if the circular plate-shaped cushion material 42 and the pressure sensor 43 are not held in a form of being tightly sandwiched by the struck head 41 and the case 40 on the lower (back) side of the struck head 41, as shown in FIG. 2B, and the pressure sensor 43 has good responsiveness to the striking on the struck head 41 to detect the intense pressure variation caused by consecutive strokes on the struck head 41 at short time intervals, the consecutive strokes on the struck head 41 and the striking of the slapping technique on the struck head 41 can still be distinguished according to the process flow of the first embodiment or the second embodiment to carry out the performance of the slapping technique.

For example, in the above embodiments, it is fine as long as whether the output of the piezoelectric sensor 44 is caused by the striking on the case 40 or the striking on the struck head 41 may be distinguished.

More specifically, in the first embodiment, if there is an output from the pressure sensor 43 when the output value of the piezoelectric sensor 44 is stored in PizR (S301), it is determined that the output of the piezoelectric sensor 44 is not caused by the striking on the case 40 but caused by the striking on the struck head 41, and the output value of the piezoelectric sensor 44 may not be stored in PizR.

In the second embodiment, if there is an output from the pressure sensor 43 when the output value of the piezoelectric sensor 44 is determined (S501), it is determined that the output of the piezoelectric sensor 44 is not caused by the striking on the case 40 but caused by the striking on the struck head 41 (S501: No), and the flag may not be set and the time counting may not start.

Needless to say, in the above embodiments, if the piezoelectric sensor 44 is completely isolated from the struck head 41 and does not detect any vibration caused by the striking on the struck head 41, it is not required to determine whether the output of the piezoelectric sensor 44 is caused by the striking on the case 40 or caused by the striking on the struck head 41.

In another example, if the struck head 41 is struck at the interval of consecutive strokes, the second stroke and the following strokes may be ignored and not deemed as a trigger of sound generation.

The above embodiments illustrate an electronic drum with the pad 4 as the electronic percussion instrument 100 provided with the sound source control information generating apparatus 10. However, the electronic percussion instrument 100 may also be a device including a housing and a touch panel that could be the struck head, such as a mobile terminal such as smart phone or mobile phone, a tablet terminal, a personal computer with a touch panel screen, and a music reproduction device, for example.

In the above embodiments, the CPU 1 is configured to perform the processes respectively shown by the flowcharts of FIG. 3 to FIG. 6 according to the control program 2*a*. In the case where the electronic percussion instrument 100 is a device installed with an operating system such as Android (registered trademark) or iOS (registered trademark), an application program based on the installed operating system may be configured for the CPU 1 to perform the processes respectively shown by the flowcharts of FIG. 3 to FIG. 6. In such a case, the application program is an example of the program of the present invention.

In the above embodiments, the sound source control information generating apparatus 10 is configured to be built in the electronic percussion instrument 100 that includes the pad 4 and the sound source 5. However, the sound source control information generating apparatus 10 may also be separated from at least one of the pad 4 and the sound source 5. Moreover, in the above embodiments, the sound source control information generating apparatus 10 is composed of the CPU 1, the ROM 2, and the RAM 3 and is configured such that the CPU 1 performs the processes shown by the flowchart of FIG. 3, etc. However, the sound source control information generating apparatus 10 may be configured to include the sound source 5, and the processes, which are performed by the CPU 1 as described above, may be performed by a DSP in the sound source 5.

In the above embodiments, the piezoelectric sensor 44 is illustrated as an example of the vibration sensor. However, other types of sensors, such as an acceleration sensor, that are capable of detecting the vibration of the housing of the electronic percussion instrument 100 may be used instead. Moreover, in the above embodiments, the piezoelectric sensor 44 disposed on the back side of the case 40 is used for detecting the vibration caused by the striking on the case 40 that serves as the housing. However, a pressure sensor may be disposed on a side surface of the housing, which is to be hit by the palm, for detecting the striking on the housing based on the output of the pressure sensor. In such a case, the pressure sensor disposed on the side surface of the housing is an example of the "first sensor" defined in the claims.

In the above embodiments, the pressure sensor 43 and the piezoelectric sensor 44 are configured to function as sensors. However, the pressure sensor 43 or the piezoelectric sensor 44 may be used solely as the sensor. Alternatively, a touch panel or a touch sensor may be used as the striking sensor.

In the first embodiment, the configuration determines whether the case 40 is struck based on whether the maximum value PizX of the output values of the piezoelectric sensor 44 stored in the ring buffer A is equal to or greater than the predetermined value. However, the method for determining whether the case 40 is struck is not limited to the above. For example, whether the case 40 is struck may be determined by whether an average of consecutive values of a predetermined number among the values stored in the ring buffer A is equal to or greater than the predetermined value. Such a method can exclude a transient variation of the output of the piezoelectric sensor 44 when determining whether the case 40 is struck.

In the above embodiments, the sound source 5 generates the musical sound of the tone of the slapping technique by assigning the tone control parameter for the slapping technique in S408 of FIG. 4. However, the sound source 5 may generate the musical sound of the slapping technique by switching effect parameters instead. More specifically, an effect parameter for the slapping technique is prepared in the ROM 2, and the CPU 1 switches from the normal effect parameter to the effect parameter for the slapping technique and outputs the same to the sound source 5 in S410.

Alternatively, an effect parameter corresponding to the level of striking of the palm on the case 40 may be prepared in advance in the ROM 2, and the CPU 1 may switch to the effect parameter corresponding to the value of PizX in S410. With such a configuration, the unique sound of the slapping technique corresponding to the strength of the striking of the player's palm can be simulated when the slapping technique is performed.

In the first embodiment, the configuration stores the output values of the piezoelectric sensor 44 in the ring buffer A. In other words, the configuration retains the output values of the predetermined time interval. However, the configuration may associate the output value of the piezoelectric sensor 44 with the time that the output value is obtained and store the output value in the RAM 3 at any time. In such a modified example, when the striking on the struck head 41 is detected, if the output value at the time included in the predetermined time interval before the time of the detection is stored in the RAM 3, it is deemed that the slapping technique is performed and the sound source 5 is controlled accordingly.

In the second embodiment, the configuration includes setting the flag provided in the RAM 3 when the output of the piezoelectric sensor 44 is equal to or greater than the predetermined value. However, the configuration may be to store the output value of the piezoelectric sensor 44 in the RAM 3. Furthermore, the time whenever the output of the piezoelectric sensor 44 is equal to or greater than the predetermined value may be stored in the RAM 3. When the striking on the struck head 41 is detected, if any of the times stored in the RAM 3 is in the predetermined time interval before the timing of detecting the striking, it is deemed that the slapping technique is performed and the sound source 5 is controlled accordingly. In the case that the time is stored, the stored time may not be erased even if the predetermined time interval lapses after the storage of the time.

In the above embodiments, the memory for storing the output values of the piezoelectric sensor 44 or the flag is not limited to the RAM 3 and may be various types of recording media installed in a media slot (not shown) provided in the electronic percussion instrument 100 or a memory device such as an external hard disk drive.

In the above embodiments, if any output of the piezoelectric sensor 44 is equal to or greater than the predetermined value in the predetermined time interval before the timing of detecting the striking on the struck head 41, the sound source 5 is controlled in the same manner regardless of a time difference between the timing of detecting the striking on the struck head 41 and the timing that the piezoelectric sensor 44 generates the output equal to or greater than the predetermined value. However, instead of the above, the configuration may vary the control of the sound source 5 according to the time difference.

The features described in the first and second embodiments or the aforementioned modified examples may be combined as appropriate for implementation.

What is claimed is:

1. A sound source control information generating apparatus, adapted for generating sound source control information which controls a sound source means that generates a musical sound based on striking on a struck head of a percussion instrument that comprises a housing and the struck head, and the sound source control information generating apparatus comprising:

a first acquisition means obtaining an output value of a first sensor that detects striking on the housing;

a second acquisition means obtaining an output value of a second sensor that detects the striking on the struck head;

a memory control means storing information that is based on the output value obtained by the first acquisition means in a memory means;

a striking detection means detecting the striking, which triggers sound generation, on the struck head based on the output value obtained by the second acquisition means;

a determining means, wherein if the striking, which triggers the sound generation, is detected by the striking detection means, the determining means determines whether the housing is struck in a predetermined time interval before a timing of detecting the striking based on a content stored in the memory means; and a generation means, wherein if the determining means determines that the housing is struck in the predetermined time interval, the generation means generates musical sound control information that differs from a situation where the determining means determines that the housing is not struck in the predetermined time interval, and wherein the musical sound control information is a tone control parameter or a volume control parameter.

2. The sound source control information generating apparatus according to claim 1, wherein if the output value obtained by the first acquisition means is determined as the striking on the housing, the memory control means stores the information that is based on the output value in the memory means to identify a timing that the output value is obtained by the first acquisition means.

3. The sound source control information generating apparatus according to claim 1, wherein the memory control means sequentially stores the information in the memory means, and the information is based on the output value obtained by the first acquisition means.

4. The sound source control information generating apparatus according to claim 1, wherein if the output value obtained by the second acquisition means is equal to or greater than a predetermined value, the memory control means does not store the information that is based on the output value obtained by the first acquisition means in the memory means.

5. The sound source control information generating apparatus according to claim 1, wherein the information that the memory control means stores in the memory means is the output value obtained by the first acquisition means, and the determining means determines that the housing is struck if the output value stored in the memory means is equal to or greater than the predetermined value, and determines that the housing is not struck if the output value stored in the memory means is not equal to or not greater than the predetermined value.

6. The sound source control information generating apparatus according to claim 1, wherein the generation means generates the musical sound control information that is based on the output value obtained by the second acquisition means if the determining means determines that the housing is not struck in the predetermined time interval, and generates the musical sound control information that is based on the output value obtained by the second acquisition means and the information stored in the memory means if the determining means determines that the housing is struck in the predetermined time interval.

7. A non-transitory computer readable medium stored with a program adapted for causing a computer to control the sound source control information generating apparatus of claim 1.

8. A sound source control information generating apparatus, adapted for generating sound source control information which controls a sound source means that generates a musical sound based on striking on a struck head of a percussion instrument that comprises a housing and the struck head, and the sound source control information generating apparatus comprising:

a first determining means determining whether the housing is struck based on a first output value, which is an output value of a first sensor that at least detects the striking on the housing;

a second determining means determining whether the striking on the struck head triggers sound generation based on a second output value, which is an output value of a second sensor that at least detects the striking on the struck head and is different from the first sensor;

a third determining means determining whether the housing is struck in a predetermined time interval before the striking that triggers the sound generation based on a determination result of the first determining means and a determination result of the second determining means; and a generation means, wherein if the third determining means determines that the housing is struck in the predetermined time interval before the striking that triggers the sound generation, the generation means generates musical sound control information that differs from a situation where the third determining means determines that the housing is not struck in the predetermined time interval before the striking that triggers the sound generation.

9. The sound source control information generating apparatus according to claim 8, further comprising a memory control means, wherein if the first determining means determines that the housing is struck, the memory control means stores information that is based on the first output value corresponding to the determination in the memory means to identify a timing of obtaining the first output value, and the third determining means determines whether the housing is struck in the predetermined time interval before the striking that triggers the sound generation based on a memory content stored in the memory means.

10. The sound source control information generating apparatus according to claim 8, further comprising a time counting means that starts counting time if the first determining means determines that the housing is struck, wherein the third determining means determines that the housing is struck in the predetermined time interval before the striking that triggers the sound generation if the second determining means determines that the striking that triggers the sound generation occurs in a time period before the predetermined time interval lapses by the time counting means.

11. The sound source control information generating apparatus according to claim 8, wherein the first determining means determines that the housing is struck if the first output value outputted by the first sensor is equal to or greater than a first predetermined value and the second output value outputted by the second sensor is not equal to or not greater than a second predetermined value at a timing that the first sensor outputs the first output value, and determines that the housing is not struck if the second output value outputted by the second sensor is equal to or greater than the second predetermined value at the timing that the first sensor outputs the first output value.

12. The sound source control information generating apparatus according to claim 8, further comprising a memory control means storing the information that is based on the first output value sequentially in the memory means, wherein the third determining means determines whether the housing is struck in the predetermined time interval before the striking that triggers the sound generation based on the information stored in the memory means.

13. The sound source control information generating apparatus according to claim 8, wherein the generation means generates the musical sound control information that is based on the second output value if the third determining means determines that the housing is not struck in the predetermined time interval before the striking that triggers the sound generation, and generates the musical sound control information that is based on the first output value and the second output value if the third determining means determines that the housing is struck in the predetermined time interval before the striking that triggers the sound generation.

14. The sound source control information generating apparatus according to claim 8, wherein the musical sound control information is a tone control parameter or a volume control parameter.

15. A sound source control information generating method, adapted for generating sound source control information which controls a sound source means that generates a musical sound based on striking on a struck head of a percussion instrument that comprises a housing and the struck head, and the sound source control information generating method comprising:

using a first determining means to determine whether the housing is struck based on a first output value, which is an output value of a first sensor that at least detects the striking on the housing;

using a second determining means to determine whether the striking on the struck head triggers sound generation based on a second output value, which is an output value of a second sensor that at least detects the striking on the struck head and is different from the first sensor;

using a third determining means to determine whether the housing is struck in a predetermined time interval before the striking that triggers the sound generation based on a determination result of the first determining means and a determination result of the second determining means, wherein if the third determining means determines that the housing is struck in the predetermined time interval before the striking that triggers the sound generation, using a generation means to generate musical sound control information that differs from a situation where the third determining means determines that the housing is not struck in the predetermined time interval before the striking that triggers the sound generation.

* * * * *